US010994548B2

(12) United States Patent
Iinuma et al.

(10) Patent No.: US 10,994,548 B2
(45) Date of Patent: May 4, 2021

(54) LIQUID RESERVOIR CONTAINER AND LIQUID EJECTION APPARATUS

(71) Applicant: CANON KABUSHIKI KAISHA, Tokyo (JP)

(72) Inventors: Keisuke Iinuma, Yokohama (JP); Kenta Udagawa, Tokyo (JP); Tatsuo Nanjo, Kawasaki (JP); Hiroshi Koshikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/536,741

(22) Filed: Aug. 9, 2019

(65) Prior Publication Data

US 2020/0079096 A1 Mar. 12, 2020

(30) Foreign Application Priority Data

Sep. 6, 2018 (JP) ..... JP2018-166883

(51) Int. Cl.
*B41J 2/175* (2006.01)

(52) U.S. Cl.
CPC ..... *B41J 2/17536* (2013.01); *B41J 2/17559* (2013.01)

(58) Field of Classification Search
CPC .... B41J 2/17536; B41J 2/17559; B41J 2/175; B41J 29/17; B41J 2/17513; B41J 2/17523; B41J 2/17509; B41J 2/1754
See application file for complete search history.

(56) References Cited

U.S. PATENT DOCUMENTS

| | | | | |
|---|---|---|---|---|
| 6,145,972 | A | 11/2000 | Udagawa et al. | 347/86 |
| 6,244,695 | B1 | 6/2001 | Udagawa | 347/86 |
| 6,293,663 | B1 | 9/2001 | Koshikawa et al. | 347/86 |
| 6,350,025 | B1 | 2/2002 | Morita et al. | 347/86 |
| 6,382,783 | B1 | 5/2002 | Hayashi et al. | 347/85 |
| 6,382,786 | B2 | 5/2002 | Iwanaga et al. | 347/86 |
| 6,390,601 | B1 | 5/2002 | Morita et al. | 347/49 |
| 6,402,298 | B1 | 6/2002 | Nanjo et al. | 347/49 |
| 6,416,173 | B2 | 7/2002 | Kishida et al. | 347/86 |
| 6,419,349 | B1 | 7/2002 | Iwanaga et al. | 347/86 |
| 6,443,567 | B1 | 9/2002 | Hayashi et al. | 347/85 |
| 6,450,631 | B1 | 9/2002 | Hayashi et al. | 347/86 |
| 6,454,400 | B1 | 9/2002 | Morita et al. | 347/86 |
| 6,471,343 | B1 | 10/2002 | Shimizu et al. | 347/85 |
| 6,505,923 | B1 | 1/2003 | Yamamoto et al. | 347/85 |
| 6,511,167 | B1 | 1/2003 | Kitabatake et al. | 347/86 |
| 6,527,381 | B1 | 3/2003 | Udagawa et al. | 347/86 |

(Continued)

*Primary Examiner* — Henok D Legesse
(74) *Attorney, Agent, or Firm* — Venable LLP

(57) ABSTRACT

Provided is a technique that enables openings for injecting liquid to be sealed with a simple and low-cost configuration. A liquid reservoir container includes: a reservoir portion configured to contain liquid in an inside of the reservoir portion and having multiple openings communicating with the inside; a supply portion connected to at least one of the openings and configured to supply liquid to the reservoir portion from a tank reserving the liquid via a flow path; and a sheet member. The liquid reservoir container supplies liquid reserved in the reservoir portion to an ejecting portion configured to eject liquid, and the sheet member is attached to the reservoir portion so as to seal an opening to which the supply portion is not connected of the multiple openings.

20 Claims, 6 Drawing Sheets

(56) References Cited

U.S. PATENT DOCUMENTS

| | | | | |
|---|---|---|---|---|
| 6,530,654 | B2 | 3/2003 | Kitabatake et al. | 347/86 |
| 6,540,342 | B2 | 4/2003 | Koshikawa et al. | 347/86 |
| 6,543,886 | B1 | 4/2003 | Hattori et al. | 347/85 |
| 6,550,898 | B2 | 4/2003 | Hayashi et al. | 347/85 |
| 6,598,963 | B1 | 7/2003 | Yamamoto et al. | 347/85 |
| 6,652,949 | B2 | 11/2003 | Iwanaga et al. | 428/65.9 |
| 6,655,542 | B2 | 12/2003 | Koshikawa et al. | 220/661 |
| 6,702,427 | B2 | 3/2004 | Shimizu et al. | 347/50 |
| 6,705,715 | B2 | 3/2004 | Morita et al. | 347/87 |
| 6,709,092 | B2 | 3/2004 | Hayashi et al. | 347/86 |
| 6,712,458 | B2 | 3/2004 | Hatasa et al. | 347/86 |
| 6,719,415 | B1 | 4/2004 | Hattori et al. | 347/86 |
| 6,742,857 | B2 | 6/2004 | Koshikawa et al. | 347/19 |
| 6,742,881 | B2 | 6/2004 | Kotaki et al. | 347/86 |
| 6,796,645 | B2 | 9/2004 | Hayashi et al. | 347/86 |
| 6,805,434 | B2 | 10/2004 | Hayashi et al. | 347/85 |
| 6,824,258 | B2 | 11/2004 | Yamamoto et al. | 347/86 |
| 6,851,798 | B2 | 2/2005 | Koshikawa et al. | 347/85 |
| 6,863,762 | B2 | 3/2005 | Sanada et al. | 156/180 |
| 6,877,848 | B2 | 4/2005 | Shimizu et al. | 347/86 |
| 6,921,161 | B2 | 7/2005 | Morita et al. | 347/86 |
| 6,942,325 | B2 | 9/2005 | Nanjo | 347/86 |
| 6,971,741 | B2 | 12/2005 | Nanjo et al. | 347/85 |
| 7,077,514 | B2 | 7/2006 | Inoue et al. | 347/86 |
| 7,104,640 | B2 | 9/2006 | Ogura et al. | 347/86 |
| 7,207,159 | B2 | 4/2007 | Nanjo et al. | 53/492 |
| 7,303,090 | B2 | 12/2007 | Nanjo et al. | 220/360 |
| 7,434,921 | B2 | 10/2008 | Udagawa | 347/85 |
| 7,552,837 | B2 | 6/2009 | Nanjo et al. | 220/360 |
| 7,854,499 | B2 | 12/2010 | Udagawa | 347/86 |
| 8,002,397 | B2 | 8/2011 | Udagawa et al. | 347/86 |
| 8,047,641 | B2 | 11/2011 | Nanjo et al. | 347/86 |
| 8,087,762 | B2 | 1/2012 | Takemura et al. | 347/85 |
| 8,205,974 | B2 | 6/2012 | Ogura et al. | 347/86 |
| 8,602,539 | B2 | 12/2013 | Rittgers et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 9,016,842 | B2 | 4/2015 | Miyashita et al. | 347/86 |
| 9,333,758 | B2 | 5/2016 | Koshikawa et al. | B41J 2/17523 |
| 9,375,938 | B2 | 6/2016 | Kondo et al. | B41J 2/1752 |
| 9,597,884 | B2 | 3/2017 | Nanjo et al. | B41J 2/17546 |
| 9,738,081 | B2 | 8/2017 | Kimura et al. | B41J 2/17509 |
| 9,821,562 | B2 | 11/2017 | Nanjo et al. | B41J 2/17553 |
| 9,840,082 | B2 | 12/2017 | Nanjo et al. | B41J 2/17526 |
| 9,908,338 | B2 | 3/2018 | Koshikawa et al. | B41J 2/17559 |
| 9,962,945 | B2 | 5/2018 | Takaoka et al. | B41J 2/17506 |
| 9,981,477 | B2 | 5/2018 | Fukuchi et al. | B41J 29/02 |
| 9,981,478 | B2 | 5/2018 | Ikebe et al. | B41J 2/175 |
| 10,118,396 | B2 | 11/2018 | Kimura et al. | B41J 2/17509 |
| 10,207,511 | B2 | 2/2019 | Nanjo et al. | B41J 2/17526 |
| 2002/0113853 | A1 | 8/2002 | Hattori et al. | 347/86 |
| 2003/0038867 | A1 | 2/2003 | Yamamoto et al. | 347/86 |
| 2003/0043241 | A1 | 3/2003 | Hattori et al. | 347/86 |
| 2009/0278900 | A1 | 11/2009 | Kondo et al. | 347/85 |
| 2015/0367647 | A1* | 12/2015 | Teramoto | B41J 2/1752 347/86 |
| 2017/0120608 | A1* | 5/2017 | Takaoka | B41J 2/17523 |

* cited by examiner

LIQUID RESERVOIR CONTAINER AND LIQUID EJECTION APPARATUS

BACKGROUND OF THE DISCLOSURE

Field of the Disclosure

The present disclosure relates to liquid ejection apparatuses including liquid ejecting heads and liquid reservoir containers for reserving liquid such as ink.

Description of the Related Art

There are known inkjet printing apparatuses of off-carriage types in which the carriage includes not only print heads but also ink reservoir containers for reserving ink to be supplied to the print heads. The ink reservoir container is supplied with ink from an ink tank located outside the ink reservoir container via a tube or the like. In such inkjet printing apparatuses, in order to perform a large amount of continuous printing, ink is supplied from the ink tank to the ink reservoir container in an amount corresponding to the amount of ink used in a printing process. In some cases, the ink reservoir container is integrated with the print head.

U.S. Pat. No. 8,602,539 discloses a technique in which injection needles for injecting ink are inserted into multiple openings provided in the lid of an ink reservoir container as described above, and ink is injected into the ink reservoir container via the injection needles. Use of such a technique, for example, makes it possible to charge ink reservoir containers with ink uniformly in a short time, before shipment.

SUMMARY OF THE DISCLOSURE

In the first aspect of the present disclosure, there is provided a liquid reservoir container comprising:

a reservoir portion configured to contain liquid in an inside of the reservoir portion and having multiple openings communicating with the inside;

a supply portion connected to at least one of the openings and configured to supply liquid to the reservoir portion from a tank reserving the liquid via a flow path; and a sheet member, wherein the liquid reservoir container supplies liquid reserved in the reservoir portion to an ejecting portion configured to eject liquid, and the sheet member is attached to the reservoir portion so as to seal an opening to which the supply portion is not connected of the multiple openings.

In the second aspect of the present disclosure, there is provided a liquid ejection apparatus comprising a liquid ejecting head including an ejecting portion configured to eject liquid, and a liquid reservoir container configured to reserve liquid supplied from a tank, wherein while the liquid ejection apparatus is moving the liquid ejecting head in a specified direction, the liquid ejection apparatus ejects liquid supplied from the liquid reservoir container, through the ejecting portion, the liquid reservoir container includes a reservoir portion configured to contain liquid in an inside of the reservoir portion and having multiple openings communicating with the inside, a supply portion connected to at least one of the openings and configured to supply liquid to the reservoir portion from the tank reserving the liquid via a flow path, and a sheet member, the liquid reservoir container supplies liquid reserved in the reservoir portion to the ejecting portion configured to eject liquid, and the sheet member is attached to the reservoir portion so as to seal an opening to which the supply portion is not connected of the multiple openings.

Further features of the present disclosure will become apparent from the following description of exemplary embodiments with reference to the attached drawings.

DESCRIPTION OF THE EMBODIMENTS

Unfortunately, in the case where ink is injected through the lid using a method as disclosed in U.S. Pat. No. 8,602,539, ink may leak out through the openings of the lid.

The present disclosure provides a technique for sealing the openings used for injecting liquid with a simple and low-cost configuration.

Hereinafter, examples of liquid reservoir containers and liquid ejection apparatuses according to the present disclosure will be described in detail with reference to the attached drawings. Note that in the following description, a liquid ejection apparatus including a liquid ejecting head that ejects liquid supplied from a liquid reservoir container will be described using an example of an inkjet printing apparatus (hereinafter, referred to as a "printing apparatus").

Figure 1:
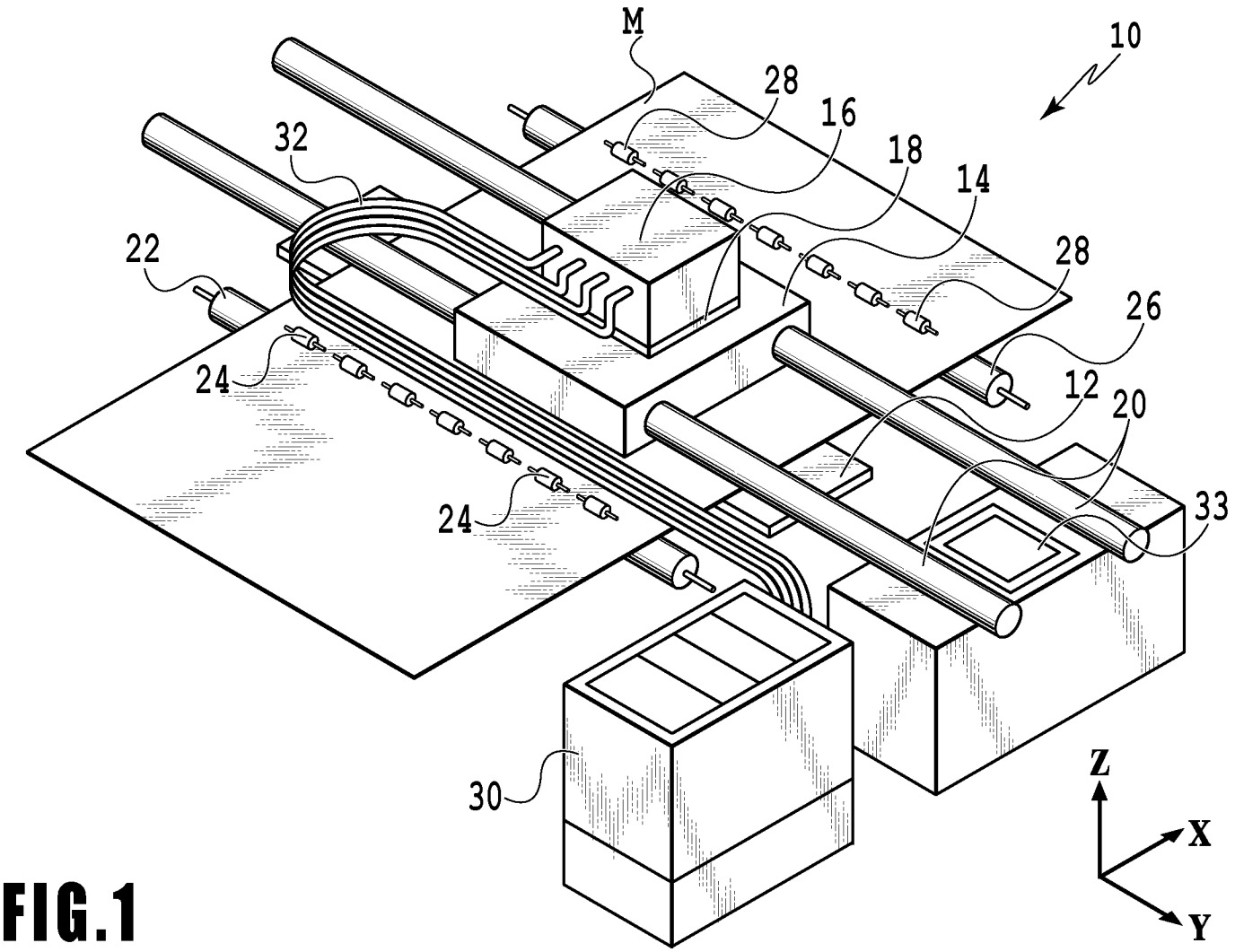
FIG. 1 is a schematic configuration diagram of a printing apparatus including liquid reservoir containers according to the present disclosure.

First, an example of an embodiment of a liquid reservoir container according to the present disclosure will be described in detail with reference to FIGS. 1 to 5C. FIG. 1 is a schematic configuration diagram illustrating a printing apparatus which is a liquid ejection apparatus including liquid reservoir containers according to the present disclosure. The printing apparatus 10 illustrated in FIG. 1 includes a platen 12 that supports a print medium M being conveyed in the X direction and a carriage 14 movable in the Y direction intersecting (here, orthogonal to) the X direction. The carriage 14 includes ink reservoir containers 16 (liquid reservoir container) that reserves ink supplied from an ink tank 30 described later and print heads 18 that ejects ink reserved in the ink reservoir containers 16. The print head 18 (liquid ejecting head) is configured to eject ink supplied from the ink reservoir container 16.

Figure 2A:
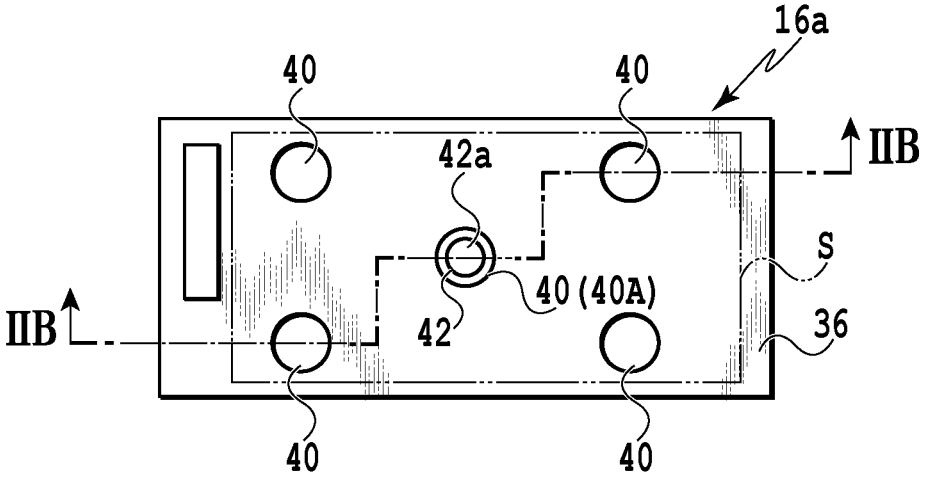
FIGS. 2A and 2B are schematic configuration diagrams illustrating a reservoir portion.
Figure 2B:
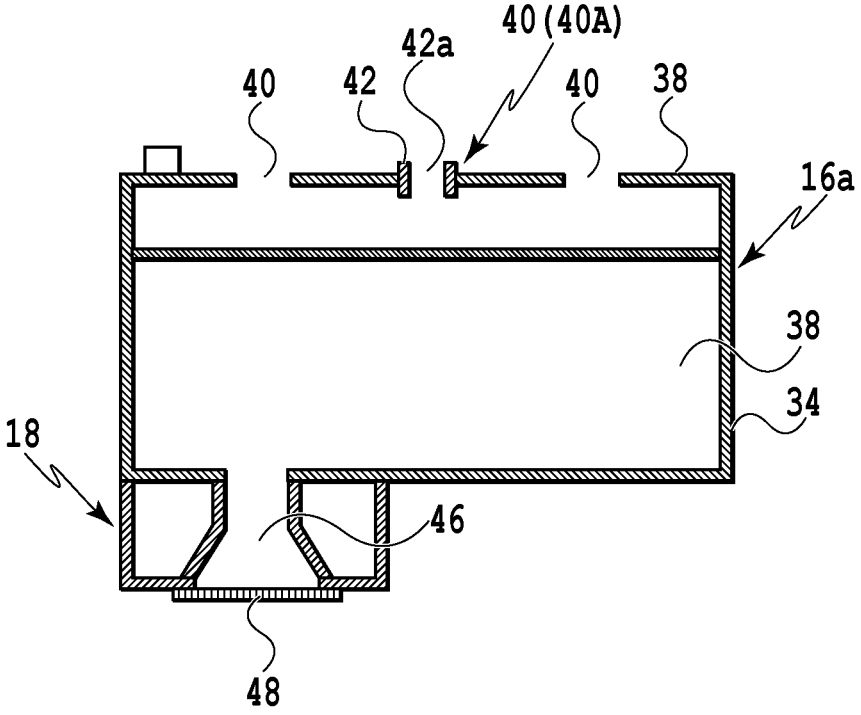

As illustrated in FIG. 2B, the print head 18 is integrated with the ink reservoir container 16. The print head 18 is located under the ink reservoir container 16 and has an ejecting portion 48 provided with multiple nozzles (not illustrated) for ejecting ink. The ejecting portion 48 faces the platen 12 and is a certain distance away from the platen 12 in the Z direction (the gravitational direction) intersecting the X and Y directions. Each nozzle of the ejecting portion 48 is provided with an ejection-energy generating element for ejecting ink. Examples of the ejection-energy generating element includes electrothermal conversion elements (heaters) and piezo elements. Ink is ejected from the nozzles corresponding to driven ejection-energy generating elements. For example, in the case where the nozzle is provided with a heater, the control unit performs control to energize the heater and thereby gives thermal energy to ink. This thermal energy causes film boiling in ink, which is utilized to eject ink from the nozzle.

A conveying roller 22 driven by a motor (not illustrated) and pinch rollers 24 that are pressure contact with the conveying roller 22 to be driven are disposed upstream of the platen 12 in the X direction. A discharging roller 26 driven by a motor (not illustrated) and spurs 28 that are pressure contact with the discharging roller 26 to be driven are disposed down of the platen 12. The print medium M is nipped by the conveying roller 22 and the pinch rollers 24 and also nipped by the discharging roller 26 and the spurs 28 to be conveyed in the X direction. Note that various media can be used for the print medium M, for example, paper, plastic material, or film.

The carriage 14 is movable forward and backward on guide shafts 20 extending in the Y direction by being driven by a motor (not illustrated). This configuration enables the print head 18 to move in the Y direction via the carriage 14. While moving in the Y direction via the carriage 14, the print head 18 ejects ink onto a print medium M being conveyed in the X direction and thereby print a specified image or the like on the print medium M. Note that the entire operation of the printing apparatus 10 is controlled by a not-illustrated control unit.

In addition, the printing apparatus 10 is provided with a recovery unit 33 for keeping and recovering the performance of the print heads 18 for ejecting ink from the nozzles. This recovery unit 33 includes a cap (not illustrated) for protecting the ejecting portion 48 of the print head 18 after printing and a wiper (not illustrated) for wiping specified areas including the ejecting portion 48.

The ink reservoir containers 16 are connected to the ink tank 30 (tank) deposed at a position away from the carriage 14 via a flexible tube 32. The tube 32 serves as a flow path for the ink between the ink tank 30 and the ink reservoir containers 16. The ink tank 30 separately reserves, for example, cyan ink, magenta ink, yellow ink, and black ink. Note that the ink reserved in the ink tank 30 is not limited to the above four colors, but the number of colors may be one to three, or five or more, including another color. Each ink reserved in the ink tank 30 is supplied to an ink reservoir container 16 provided for each color via the tube 32.

FIGS. 2A and 2B are schematic configuration diagrams illustrating a reservoir portion 16*a* of the ink reservoir container 16. FIG. 2A is a plan view, and FIG. 2B is an end view of the cross section taken along line IIB-IIB in FIG. 2A. The ink reservoir container 16 for the ink of each color has the same configuration. The ink reservoir container 16 includes the reservoir portion 16*a* that reserves ink and a supply portion 16*b* (see FIG. 4A) that is connected to the tube 32 and supplies ink to the reservoir portion 16*a*.

The reservoir portion 16*a* includes a case 34 having an opening upper face and approximately in a box shape and a lid 36 that covers the opening upper face of the case 34. Note that the connecting portion between the case 34 and the lid 36 is, for example, welded and joined. An absorbent 38 capable of holding ink is disposed inside the case 34. The lid 36 has multiple openings 40. The openings 40 communicate with the inside of the reservoir portion 16*a*. In this configuration, ink can be injected into the inside of the reservoir portion 16*a* via these openings 40. In FIGS. 2A and 2B, the openings 40 are formed at five positions in total, that is, a position approximately at the center of the lid 36 and four positions each being a specified distance away from this position. Note that an elastic member 42 made of, for example, an elastic resin material such as rubber is disposed only at the opening 40 located approximately at the center of the lid 36 (hereinafter referred to as the "opening 40A" as appropriate). This elastic member 42 has an opening 42*a* into which an other end 54*b* of a flow path 54 described later can be inserted and fitted.

The print head 18 is located on the face of the case 34 opposite from the lid 36 (on the lower face). The print head 18 includes an ejecting portion 48 having the multiple nozzles that eject ink and a flow path 46 for supplying ink reserved in the reservoir portion 16*a* to each nozzle of the ejecting portion 48. The nozzles are at the extremity of the flow path 46.

Figure 3A:
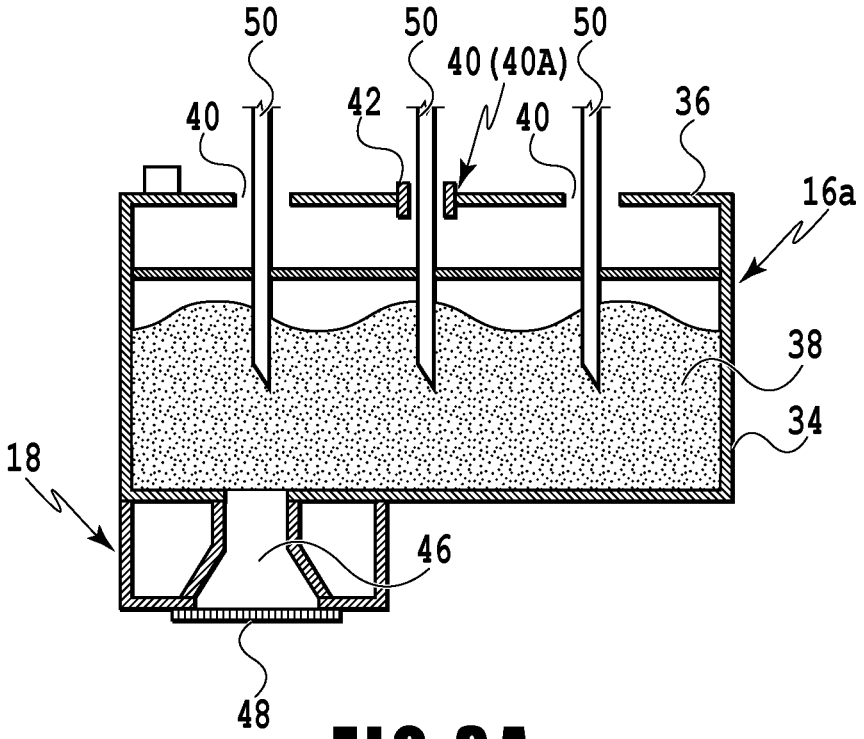
FIGS. 3A and 3B are diagrams illustrating the reservoir portion at the time of initial charge and after the initial charge.
Figure 3B:
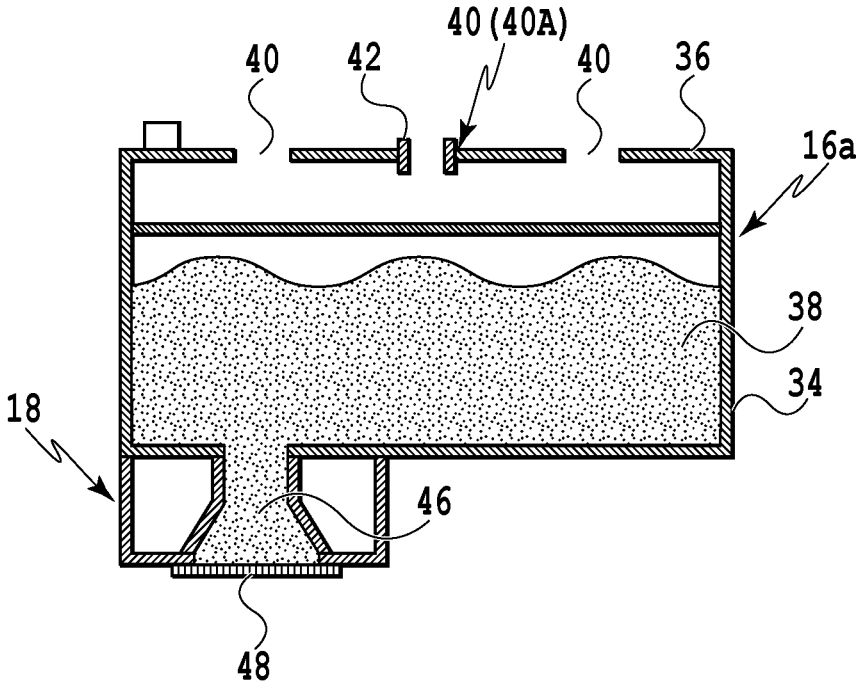

FIG. 3A is a diagram illustrating the reservoir portion 16*a* at the time of initial charge. FIG. 3B is a diagram illustrating the reservoir portion 16*a* after the initial charge. The ink reservoir container 16 is shipped with ink charged, for example, in order to be available for the user immediately upon arrival. The process for charging the reservoir portion 16*a* of the ink reservoir container 16 with ink before shipment is referred to as an initial charge (initial charge process) as appropriate. At the initial charge for the ink reservoir container 16 (the reservoir portion 16*a*), first, injection needles 50 for injecting ink are inserted into the openings 40 including the opening 40A. In the following description, "the openings 40" include the opening 40A unless otherwise noted. After that, ink is injected through the injection needles 50, and the injected ink is held by the absorbent 38 (see FIG. 3A). The ink absorbed by the absorbent 38 moves downward in the gravitational direction by its own weight, reaches the inside of the flow path 46 of the ejecting portion 48, and is reserved in the flow path 46 (see FIG. 3B).

Figure 4A:
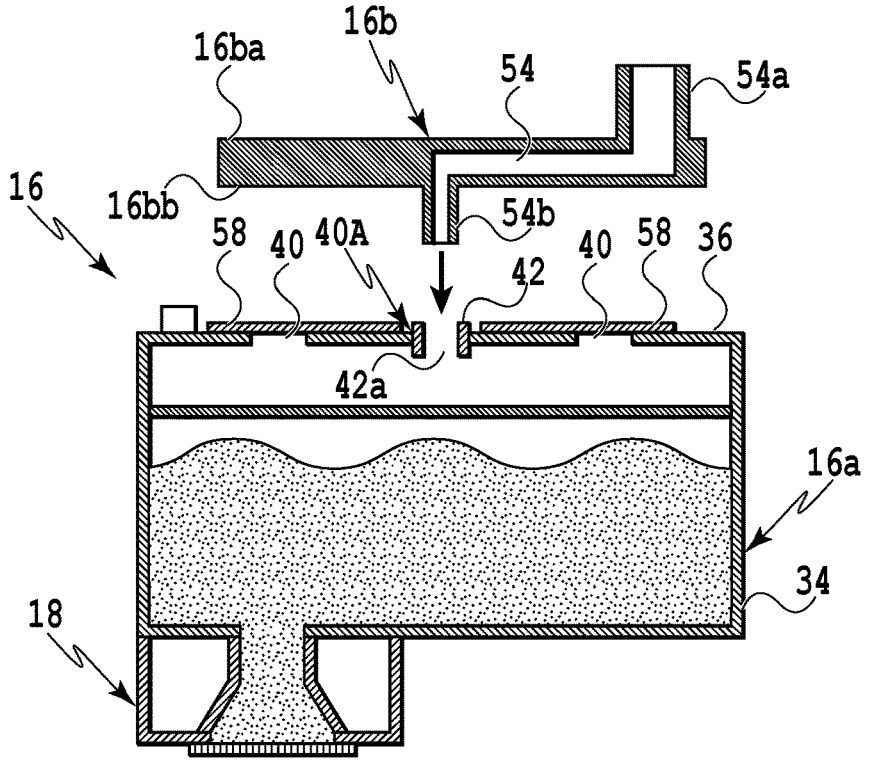
FIGS. 4A and 4B are diagrams for explaining the configuration of the ink reservoir container.
Figure 4B:
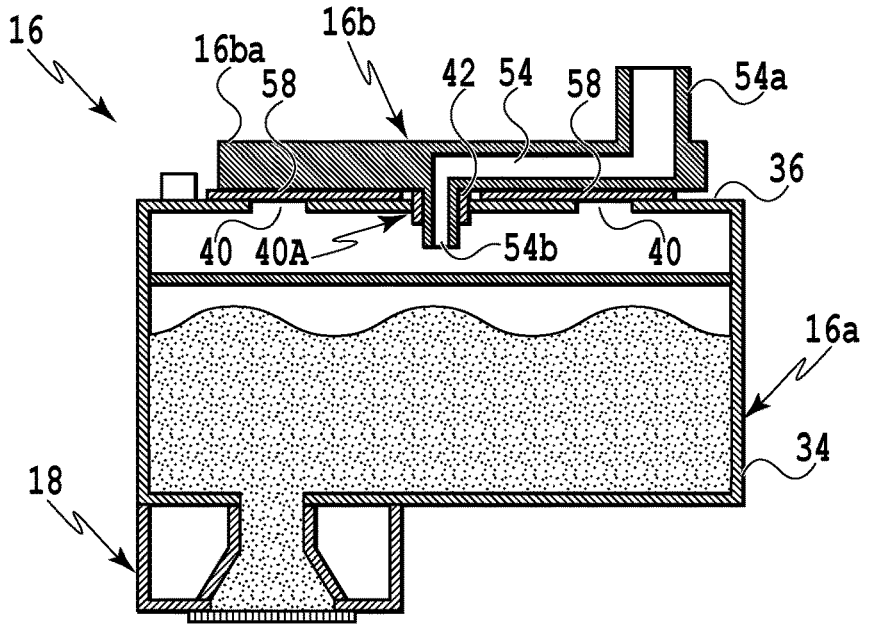

After the initial charge for the reservoir portion 16*a* finishes as above, the supply portion 16*b* is connected to the reservoir portion 16*a*. FIGS. 4A and 4B are schematic configuration diagrams illustrating the ink reservoir container 16. FIG. 4A is a diagram illustrating the reservoir portion 16*a* after the initial charge and the supply portion 16*b* which are away from each other; FIG. 4B is a diagram illustrating the reservoir portion 16*a* after the initial charge and the supply portion 16*b* connected to each other.

The supply portion 16*b* is capable of covering a specified area S (see FIG. 2A) including the openings 40 of the lid 36 and has a plate shape having a specified thickness. The supply portion 16*b* has inside the flow path 54 passing from a one face 16*ba* to an other face 16*bb*. A one end 54*a* of the flow path 54 is formed to protrude from the one face 16*ba*, and the other end 54*b* of the flow path 54 is formed to protrude from a position approximately at the center position of the other face 16*bb*.

The tube 32 is connected to the one end 54*a* of the flow path 54, into which the ink supplied from the ink tank 30 flows via the tube 32. The other end 54*b* of the flow path 54 has a shape that can be inserted and fitted into the opening 42*a* of the elastic member 42 disposed at the opening 40A. Insertion of the other end 54*b* into the opening 42*a* eliminates the gap between the opening 42*a* and the other end 54*b*, sealing the opening 40A.

For the reservoir portion 16*a* for which the initial charge process has been completed, a sheet member 58 is attached to the lid 36 such that it covers the openings 40 excluding the opening 40A, and thus, these openings 40 are sealed. After that, the supply portion 16*b* is connected to the reservoir portion 16*a*.

The sheet member 58 includes, for example, a base material made of a resin material. As alternatives, one sheet member 58 may seal all the openings 40, one sheet member 58 may seal some of the openings 40, or one sheet member 58 may seal one opening 40. Thus, the number of sheet members 58 may be two or more.

The sheet member 58 should preferably have a thickness that does not make it difficult to insert and fit the other end 54*b* of the flow path 54 into the opening 42*a* of the elastic member 42. Note that the thickness of the sheet member 58 means the length in the direction in which the supply portion 16*b* is inserted and fitted into the elastic member 42 (here, the height direction, in other words, the gravitational direction). The sheet member 58 may be, for example, attached to the lid 36 using an adhesive (including glue). As an alternative, the sheet member 58 may be, for example, welded to the lid 36 under a specified condition. Thus, examples of the sheet member 58 include labels and films.

After the sheet member 58 is attached to the reservoir portion 16*a* to seal the openings 40 excluding the opening 40A, the supply portion 16*b* is connected to the reservoir portion 16*a* by inserting and fitting the other end 54*b* of the flow path 54 into the opening 42*a* of the elastic member 42 disposed at the opening 40A. With this operation, the reservoir portion 16*a* and the ink tank 30 communicate with each other via the flow path 54 and the tube 32. Note that the other face 16*bb* of the supply portion 16*b* should preferably be in close contact with the sheet member 58 in the state in which the flow path 54 is inserted and fitted into the opening 40A. This enables the openings 40 excluding the opening 40A to be reliably sealed with the sheet member 58.

Since the absorbent 38 holds ink in the ink reservoir container 16, the user can perform printing on print media immediately after the printing apparatus 10 arrives. The ink reservoir container 16 is in the state in which ink can be supplied from the ink tank 30 via the tube 32 and the flow path 54 and also in the state in which ink in an amount corresponding to the amount of ejected ink flows into the ink reservoir container 16. To be more specific, since the openings 40 are sealed, the water head difference between the liquid surface of the ink inside the reservoir portion 16*a* and the liquid surface of the ink reserved in the ink tank 30 generates a negative pressure inside the ink reservoir container 16. In printing, ejecting ink from the nozzles of the ejecting portion 48 increases the negative pressure inside the ink reservoir container 16, and thus, ink in an amount corresponding to the amount of ejected ink flows into the ink reservoir container 16 via the flow path 54.

Figure 5A:
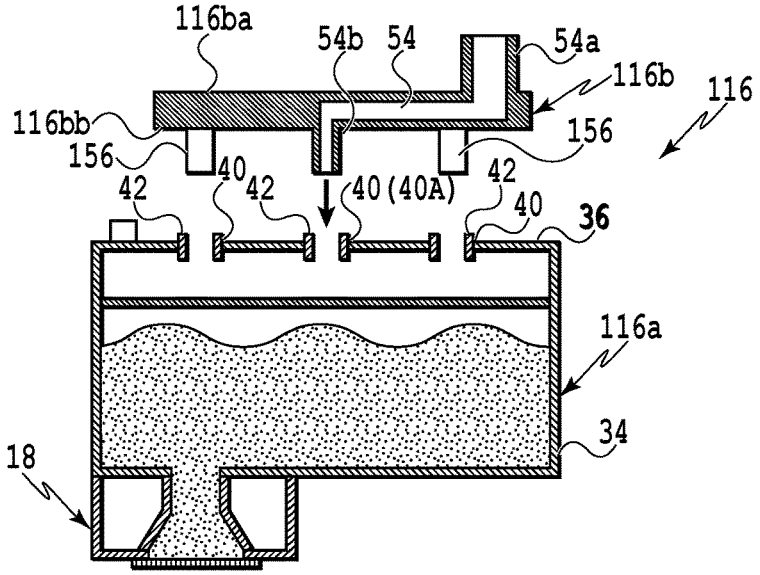
FIGS. 5A, 5B, and 5C are diagrams for explaining the configuration of a comparative example of an ink reservoir container.
Figure 5B:
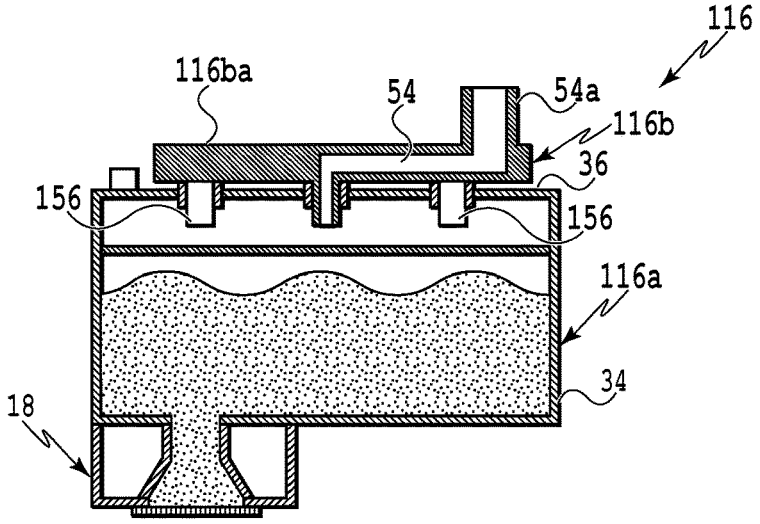
Figure 5C:
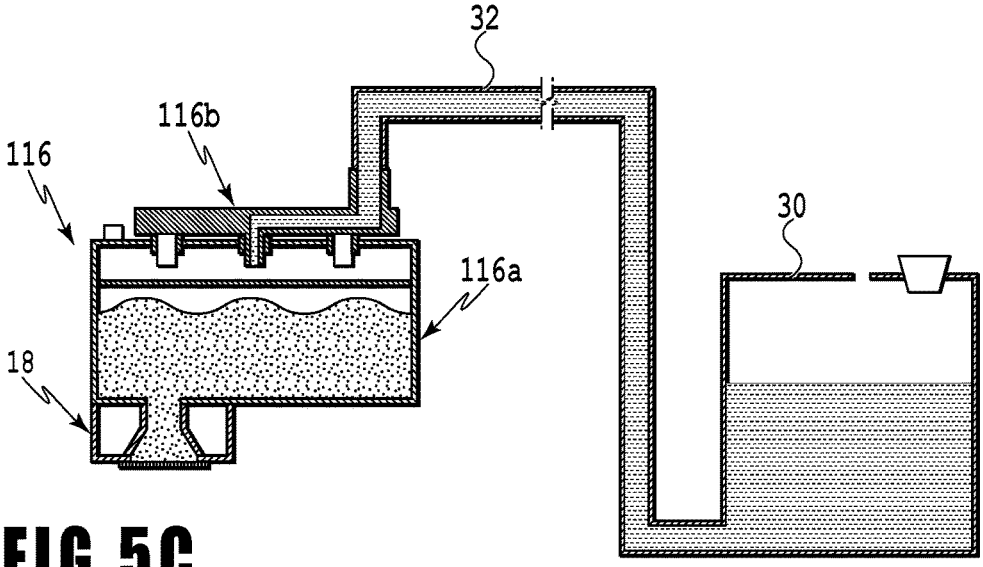

Next, an ink reservoir container 116 illustrated in FIGS. 5A, 5B, and 5C will be described. FIGS. 5A, 5B, and 5C are schematic configuration diagrams illustrating the ink reservoir container 116. FIG. 5A is a diagram illustrating a reservoir portion 116*a* and a supply portion 116*b* at a time before they are not connected. FIG. 5B is a diagram illustrating the reservoir portion 116*a* and the supply portion 116*b* at a time after they have been connected. FIG. 5C is a diagram illustrating the ink reservoir container 116 in a state in which ink can be supplied from the ink tank 30. This ink reservoir container 116 is a comparative example for the present disclosure. Thus, the same constituents as in the above ink reservoir container 16 or equivalent constituents are denoted by the same reference numerals, and detailed description of those constituents will be omitted as appropriate.

The reservoir portion 116*a* of the ink reservoir container 116 is different from the reservoir portion 16*a* in that the elastic member 42 is disposed at each of the openings 40 provided in the lid 36. In addition, the supply portion 116*b* of the ink reservoir container 116 has, on an other face 116*bb*, protrusions 156 which can be inserted and fitted into the openings 42*a* of the elastic members 42. The protrusions 156 are provided at the positions corresponding to the openings 40 excluding the opening 40A in the state in which the other end 54*b* of the flow path 54 is inserted into the opening 42*a* of the elastic member 42 disposed at the opening 40A. Insertion of these protrusions 156 into the openings 42*a* eliminates the gaps between the opening 42*a* and the protrusions 156, sealing these openings 40.

To connect the tube 32 to the reservoir portion 116*a* via the supply portion 116*b*, the other end 54*b* of the flow path 54 is inserted and fitted into the elastic member 42 for the opening 40A, and at the same time, the protrusions 156 are also inserted and fitted into the elastic members 42 for the openings 40. As a result of this operation, the ink reservoir container 116 and the ink tank 30 communicate with each other via the tube 32 and the flow path 54. In addition, the openings 40 excluding the opening 40A of the reservoir portion 116*a* are sealed by the protrusions 156.

In the ink reservoir container 116, the elastic member 42 is disposed at each opening 40 to seal the openings 40 excluding the opening 40A to be connected to the flow path 54 as described above. In this configuration, the protrusions 156 provided on the supply portion 116*b* are inserted and fitted into the openings 42*a* of the elastic members 42. For this reason, the ink reservoir container 116 needs to include the elastic member 42 for each opening 40, increasing the part count. This requires a process for assembling the elastic member 42 for each opening 40 in the production process for the ink reservoir container 116. In production for the supply portion 116*b*, the shapes and the positions of the protrusions 156 require high accuracy so that they can be inserted and fitted into the openings 42*a*.

In contrast, the ink reservoir container 16 of the present disclosure includes the sheet member 58 to seal the openings 40. The sheet member 58 covers the openings 40 to seal them. For this purpose, the sheet member 58 has a size larger than the area including the positions of the openings 40 to be sealed, and the sheet member 58 is attached to the lid 36 so as to cover those openings 40. Thus, the ink reservoir container 16 of the present disclosure does not need a process for inserting the elastic members 42 into the respective openings 40 excluding the opening 40A, unlike the ink reservoir container 116 including the elastic members 42 for the respective openings 40.

In addition, the ink reservoir container 16 of the present disclosure only requires the sheet member to be attached so as to cover the opening 40, and thus the configuration for sealing the openings 40 is simpler than the ink reservoir container 116 in which the elastic member 42 is inserted into each opening 40 and the protrusions 156 are inserted into the opening 42*a*. Further, the configuration in which the sheet member 58 seals multiple openings 40 makes it possible to reduce the part count and thus reduce the cost. In addition, the sheet member 58 only needs to cover the openings 40 in the process for attaching the sheet member 58 to the lid 36, and thus, even in the case where accuracy in positioning the sheet member 58 relative to the openings 40 to be sealed is somehow low, the openings 40 can be sealed reliably.

Next, another embodiment of a liquid reservoir container according to the present disclosure will be described with reference to FIGS. 6A and 6B. Note that in the following description, the same constituents as in the above printing apparatus 10 or equivalent constituents are denoted by the same reference numerals, and detailed description of those constituents will be omitted as appropriate.

Figure 6A:
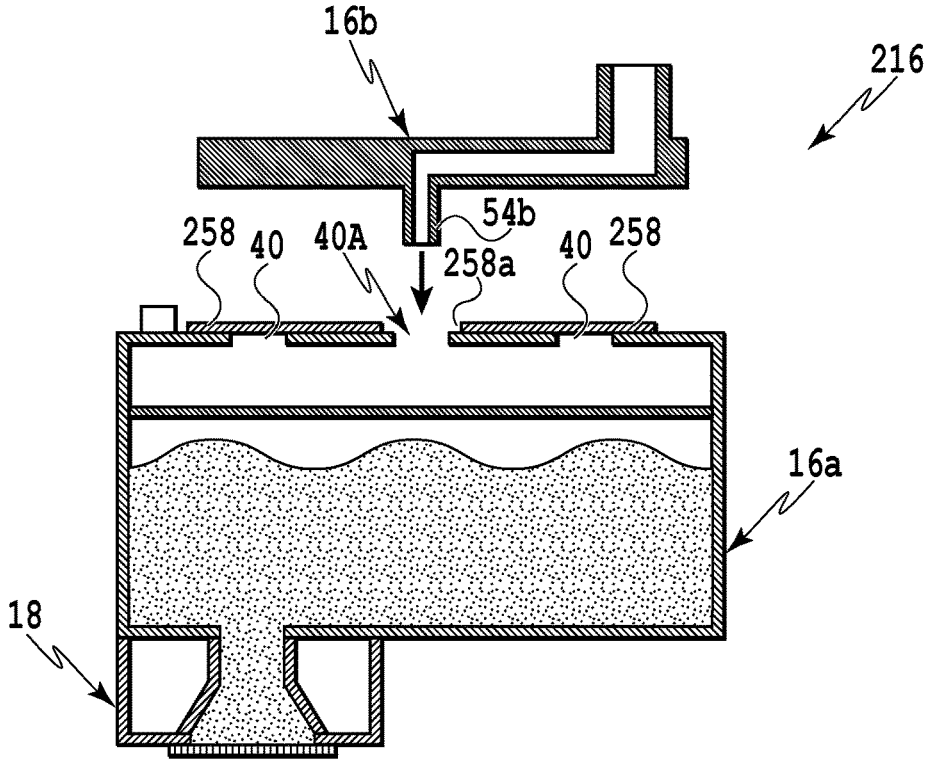
FIGS. 6A and 6B are diagrams for explaining the configuration of an ink reservoir container.
Figure 6B:
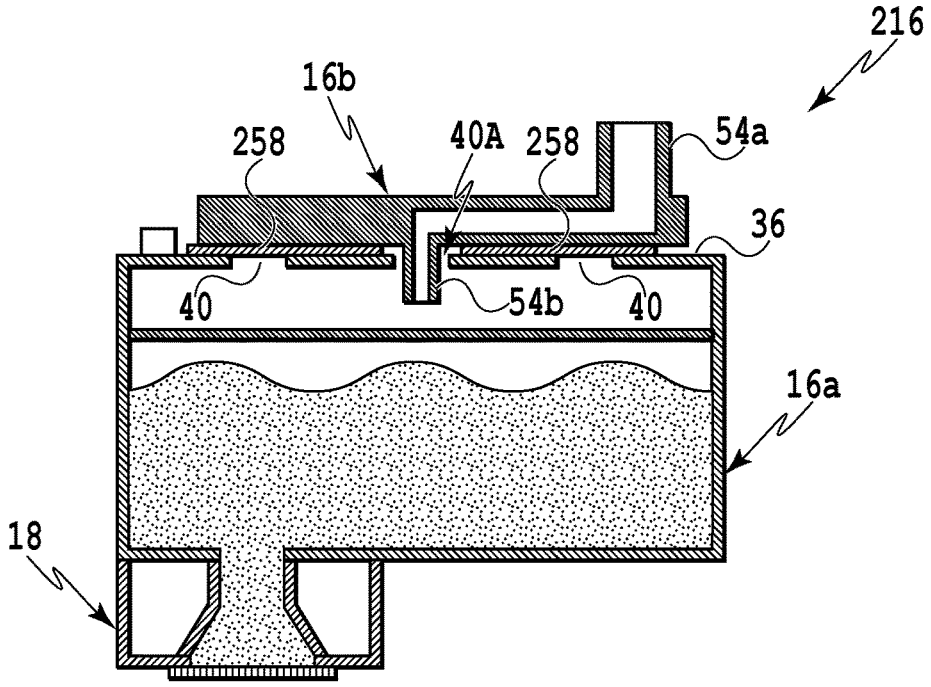

An ink reservoir container 216 illustrated in FIGS. 6A and 6B is different from the ink reservoir container 16 illustrated in FIGS. 4A and 4B in that the opening 40A is sealed with a sheet member 258 and the supply portion 16*b*.

Specifically, the ink reservoir container 216 in FIGS. 6A and 6B includes the sheet member 258 formed to cover the openings 40 excluding the opening 40A. The sheet member 258 has an opening 258*a* associated with the opening 40A. Note that the opening 258*a* should preferably have a larger diameter than the opening 40A. The opening 258*a* is configured not to communicate with the outside in the state in which the supply portion 16*b* is connected to the reservoir portion 16*a*. The sheet member 258 has adhesive functions on both surfaces (the surface facing the lid 36 and the surface facing the supply portion 16*b*). To be more specific, for example, an adhesive or a glue may be applied to both surfaces of the sheet member 258, or both surfaces of the sheet member 258 may be weldable under a specified condition. Note that the ink reservoir container 216 does not include the elastic member 42 at each of the openings 40 including the opening 40A.

For the ink reservoir container 216 for which the initial charge has been completed, the sheet member 258 is attached to the lid 36 such that the opening 40A is positioned within the opening 258*a* (FIGS. 6A and 6B). After that, while the other end 54*b* of the flow path 54 is being inserted into the opening 40A, the supply portion 16*b* is attached to the sheet member 258. With this operation, the openings 40 excluding the opening 40A are sealed with the sheet member 258. The opening 40A is sealed with the sheet member 258 and the supply portion 16*b*.

As has been described above, the ink reservoir container 216 includes the sheet member 258 that covers the openings 40 excluding the opening 40A. This sheet member 258 has adhesive functions on both surfaces, and thus the sheet member 258 can be attached to the reservoir portion 16*a* and the supply portion 16*b*. Note that the elastic member 42 is not disposed at the opening 40A. With this configuration, the openings 40 excluding the opening 40A are sealed with the sheet member 258, and the opening 40A is sealed with the sheet member 258 and the supply portion 16*b*. Thus, the ink reservoir container 216 has a more simplified configuration than the ink reservoir container 16, and thus has a less part count and requires a smaller number of processes for the production.

The embodiments described above may be modified as in the following (1) to (5).

(1) Although in the above embodiments, the supply portion 16*b* has the other end 54*b* of the flow path 54 at the position corresponding to the position of the opening 40A of the reservoir portion 16*a*, the present disclosure is not limited to this configuration. Specifically, the other end 54*b* of the flow path 54 may be located at the position facing one of the openings 40 excluding the opening 40A. In addition, although in the above embodiments, the flow path 54 is connected to one of the multiple openings 40 to be capable of supplying ink into the reservoir portion 16*a*, the present disclosure is not limited to this configuration. Specifically, flow paths 54 may be connected to two or more openings 40 (in this case, the supply portion 16*b* has multiple flow paths 54), and ink may be supplied into the reservoir portion 16*a* via the multiple openings 40.

(2) Although in the above embodiments, the lid 36 of the reservoir portion 16*a* has five openings 40, the present disclosure is not limited to this configuration. Specifically, the lid 36 may have two to four openings 40, or it may have six or more. In addition, although in the above embodiment, the absorbent 38 is disposed inside the reservoir portion 16*a*, the present disclosure is not limited to this configuration. Specifically, a configuration in which the absorbent 38 is not disposed in the reservoir portion 16*a* is possible.

(3) although in the above embodiment, a description has been provided for the case where ink is used as the liquid to be ejected, the liquid reserved in the liquid reservoir container according to the present disclosure is not limited to ink. In other words, various kinds of liquid for printing may be used for the liquid, including treatment liquids or the like used for the purpose of improving the fixability of ink on print media, reducing gloss unevenness, and improving the scratch resistance.

(4) Although in the above embodiments, the ink reservoir container 16 includes the sheet member 58 to seal the openings 40 including the opening 40A, the present disclosure is not limited to this configuration. Specifically, a configuration in which at least one of the openings 40 excluding the opening 40A is sealed with the sheet member 58 is possible.

(5) Although the embodiment described with reference to FIGS. 6A and 6B does not have, an elastic member 42 at the opening 40A, the present disclosure is not limited to this configuration. A configuration in which the elastic member 42 is disposed at the opening 40A such that the sheet member 258 can be adhesively attached to the reservoir portion 16*a* and the supply portion 16*b* is possible.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-166883, filed Sep. 6, 2018, which is hereby incorporated by reference wherein in its entirety.

What is claimed is:

1. A liquid reservoir container comprising:

a reservoir portion configured to contain liquid in an inside of the reservoir portion and having multiple openings communicating with the inside;

a supply portion connected to at least one of the openings and configured to supply liquid to the reservoir portion from a tank reserving the liquid via a flow path; and a sheet member having an opening, wherein the multiple openings of the reservoir portion include a first opening to which the supply portion is connected to the reservoir portion and a second opening in which the supply portion and the reservoir portion are not connected, the liquid reservoir container supplies liquid reserved in the reservoir portion to an ejecting portion configured to eject liquid, and the opening of the sheet member is disposed to surround the first opening to which the supply portion is connected to the reservoir portion, and the sheet member is attached to the reservoir portion so as to seal the second opening in which the supply portion and the reservoir portion are not connected.

2. The liquid reservoir container according to claim 1, wherein the sheet member is attached to the supply portion.

3. The liquid reservoir container according to claim 1, wherein the sheet member is attached with an adhesive.

4. The liquid reservoir container according to claim 1, wherein the sheet member is attached by welding.

5. The liquid reservoir container according to claim 1, wherein the reservoir portion is provided with an absorbent capable of holding liquid.

6. The liquid reservoir container according to claim 1, wherein an elastic member into which part of the supply portion is able to be inserted and fitted is disposed at the first opening to which the supply portion is connected to the reservoir portion, and the first opening to which the supply portion is connected to the reservoir portion is sealed by the part of the supply portion being inserted and fitted into the elastic member.

7. The liquid reservoir container according to claim 1, wherein the first opening to which the supply portion is connected to the reservoir portion is sealed the supply portion and the second opening in which the supply portion and the reservoir portion are not connected is sealed by the sheet member.

8. The liquid reservoir container according to claim 1, wherein the first opening to which the supply portion is connected to the reservoir portion is located in the center of the reservoir portion.

9. The liquid reservoir container according to claim 1, further comprising a liquid ejecting head that has an ejecting portion configured to eject liquid and is configured to eject liquid supplied from the reservoir portion, through the ejecting portion.

10. The liquid reservoir container according to claim 1, wherein the sheet member is one sheet member.

11. A liquid ejection apparatus comprising a liquid ejecting head including an ejecting portion configured to eject liquid, and a liquid reservoir container configured to reserve liquid supplied from a tank, wherein while the liquid ejection apparatus is moving the liquid ejecting head in a specified direction, the liquid ejection apparatus ejects liquid supplied from the liquid reservoir container, through the ejecting portion, the liquid reservoir container includes a reservoir portion configured to contain liquid in an inside of the reservoir portion and having multiple openings communicating with the inside, a supply portion connected to at least one of the openings and configured to supply liquid to the reservoir portion from the tank reserving the liquid via a flow path, and a sheet member having an opening, the multiple openings of the reservoir portion include a first opening to which the supply portion is connected to the reservoir portion and a second opening in which the supply portion and the reservoir portion are not connected, the liquid reservoir container supplies liquid reserved in the reservoir portion to the ejecting portion configured to eject liquid, and the opening of the sheet member is disposed to surround the first opening to which the supply portion is connected to the reservoir portion, and the sheet member is attached to the reservoir portion so as to seal the second opening in which the supply portion and the reservoir portion are not connected.

12. The liquid ejection apparatus according to claim 11, wherein the sheet member is attached to the supply portion.

13. The liquid ejection apparatus according to claim 11, wherein the sheet member is attached with an adhesive.

14. The liquid ejection apparatus according to claim 11, wherein the sheet member is attached by welding.

15. The liquid ejection apparatus according to claim 11, wherein the reservoir portion is provided with an absorbent capable of holding liquid.

16. The liquid ejection apparatus according to claim 11, wherein an elastic member into which part of the supply portion is able to be inserted and fitted is disposed at the first opening to which the supply portion is connected to the reservoir portion, and the first opening to which the supply portion is connected to the reservoir portion is sealed by the part of the supply portion being inserted and fitted into the elastic member.

17. The liquid ejection apparatus according to claim 11, wherein the first opening to which the supply portion is connected to the reservoir portion is sealed the supply portion and the second opening in which the supply portion and the reservoir portion are not connected is sealed by the sheet member.

18. The liquid ejection apparatus according to claim 11, wherein the first opening to which the supply portion is connected to the reservoir portion is located in the center of the reservoir portion.

19. The liquid ejection apparatus according to claim 11, further comprising a liquid ejecting head that has an ejecting portion configured to eject liquid and is configured to eject liquid supplied from the reservoir portion, through the ejecting portion.

20. The liquid ejection apparatus according to claim 11, wherein the sheet member is one sheet member.

* * * * *